US006657521B2

(12) United States Patent
Tatomir et al.

(10) Patent No.: US 6,657,521 B2
(45) Date of Patent: Dec. 2, 2003

(54) MICROWAVE WAVEGUIDE FILTER HAVING RECTANGULAR CAVITIES, AND METHOD FOR ITS FABRICATION

(75) Inventors: Paul J. Tatomir, Fallbrook, CA (US); James M. Barker, Torrance, CA (US); Keith N. Loi, Monterey Park, CA (US); Richard L. Bennett, Torrance, CA (US); Louis W. Hendrick, Hermosa Beach, CA (US); Rolf Kich, Redondo Beach, CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 10/132,949

(22) Filed: Apr. 26, 2002

(65) Prior Publication Data

US 2003/0201850 A1 Oct. 30, 2003

(51) Int. Cl.[7] ..... H01P 7/10
(52) U.S. Cl. ..... 333/208; 333/210
(58) Field of Search ..... 333/208–212

(56) References Cited

U.S. PATENT DOCUMENTS 4,725,797 A 2/1988 Thompson et al. ..... 333/212
5,781,085 A * 7/1998 Harrison ..... 333/202
5,801,606 A 9/1998 Schubert et al. ..... 333/208
5,867,077 A 2/1999 Lundquist ..... 333/208
6,104,262 A * 8/2000 Kich ..... 333/212
6,297,715 B1 10/2001 Fiedziuszko et al. ..... 333/209

* cited by examiner

*Primary Examiner*—Timothy P. Callahan
*Assistant Examiner*—An T. Luu

(57) ABSTRACT

A microwave waveguide filter includes a main-line cavity structure with a group of at least two rectangular main-line cavities arrayed along a main propagation path and including a first main-line cavity and a second main-line cavity. Each main-line cavity includes a sidewall, and each pair of adjacent main-line cavities has a common transverse wall transverse to the main propagation path and a main-line aperture in the common transverse wall. A rectangular first feedback cavity is in microwave communication with each of the first main-line cavity and the second main-line cavity through the respective sidewall of the first main-line cavity and the second main-line cavity. There is a first-cavity feedback aperture between the first feedback cavity and the first main-line cavity, and a second-cavity feedback aperture between the first feedback cavity and the second main-line cavity. There may be additional feedback cavities as well.

18 Claims, 6 Drawing Sheets

MICROWAVE WAVEGUIDE FILTER HAVING RECTANGULAR CAVITIES, AND METHOD FOR ITS FABRICATION

This invention relates to microwave waveguide filters and, more particularly, to a compact design that is readily manufactured.

BACKGROUND OF THE INVENTION

Satellite communications systems relay the communications signals as microwaves. A microwave communications signal is up-transmitted from a first earth station to the communications satellite, processed on board the satellite, and down-transmitted to a second earth station. Typically, many channels of communications signals are relayed simultaneously.

The on-board processing of the communications signals usually involves filtering the microwave communications signals, amplifying the signals, and possibly other signal conditioning. Because many channels are transmitted simultaneously and because the communications are subject to various types of interference, it is important that the microwave signals be filtered to remove noise and any undesirable components, and to ensure separation between the signal bands.

On-board microwave signals may be propagated in any suitable fashion. The main approaches are within waveguides, on striplines, and between coaxial conductors. Each of these propagation media has filters available. The present invention is concerned with one of these, the microwave waveguide filter.

The usual approach to the microwave waveguide filter is to provide suitably configured and sized cavities in the waveguide. Resonant modes are produced in the cavities, with the result that the microwave energy leaving the microwave waveguide filter is filtered responsive to the configuration and size of the cavity or cavities. Such microwave waveguide filters are operable and are widely used, but they have drawbacks. The existing designs are usually relatively complex structures that are difficult and expensive to manufacture, with high piece counts, resulting in expensive and time-consuming assembly. They may also be difficult, time consuming, and expensive to tune property and to maintain tuned.

There is therefore a need for an improved design for a microwave waveguide filter. The present invention fulfills this need, and further provides related advantages.

SUMMARY OF THE INVENTION

The present invention provides a microwave waveguide filter for quasi-elliptical filtering of microwave signals. The microwave waveguide filter is readily and inexpensively manufactured, and has a low piece count of parts. Additionally, the filtering performance of the design is readily predicted theoretically, reducing the trial-and-error, and thus the time and expense, to tune the filter performance. The design is particularly suited for cross coupled cavity resonator filters for use in the K band and at higher frequencies.

In accordance with the invention, a microwave waveguide filter comprises a main-line cavity structure comprising a group of at least two rectangular main-line cavities arrayed along a main propagation path and including a first main-line cavity and a second main-line cavity. Each main-line cavity includes a sidewall. Each pair of adjacent main-line cavities has a common transverse wall therebetween transverse to (and preferably perpendicular to) the main propagation path, and a main-line aperture in the common transverse wall. There is a rectangular first feedback cavity in microwave communication with each of the first main-line cavity and the second main-line cavity through the respective sidewall of the first main-line cavity and the second main-line cavity. Thus, there is a first-cavity feedback aperture between the first feedback cavity and the first main-line cavity, and a second-cavity feedback aperture between the first feedback cavity and the second main-line cavity.

Preferably, the main-line cavities and the first feedback cavity have a base wall (i.e., a floor) that lies in a common filter plane. The main-line cavity structure may be linear and unfolded, so that the main propagation path is substantially a straight line. The main-line cavity structure may instead be nonlinear and folded, so that the main propagation path is not substantially a straight line.

In one embodiment, the main-line cavity structure includes an input-end main-line cavity at a first end of the main-line cavity structure, and an output-end main-line cavity at a second end of the main-line cavity structure. The main-line cavity structure further includes an input structure in microwave communication with the input-end main-line cavity, and an output structure in microwave communication with the output-end main-line cavity.

The size of the feedback cavity is selected to provide the desired filtering. In an example, a first-cavity sidewall of the first main-line cavity and a second-cavity sidewall of the second main-line cavity are parallel (and preferably coplanar) and both of a first-sidewall length. The first feedback cavity has a first-feedback-cavity sidewall that is parallel to the first-cavity sidewall and the second-cavity sidewall. The first-feedback-cavity sidewall has a first-feedback-cavity-sidewall length of about the first-sidewall length in one embodiment, and the first-feedback-cavity-sidewall length of about two times the first-sidewall length in another embodiment.

Most conveniently, the main-line cavity structure and the first feedback cavity are formed in a single filter block of material, as by machining and preferably by milling. A single cover is provided to overlie the machined-out main-line cavity structure and to be affixed to the single filter block of material. With this approach, a second microwave waveguide filter may be readily machined into the opposing side of the single filter block of material, in a back-to-back relation to the microwave waveguide filter.

The main-line cavity structure may be extended to include a third main-line cavity, a fourth main-line cavity, and additional main-line cavities as desired. One reason to extend the main-line cavity structure is to add one or more additional feedback cavities. For example, the main-line cavity structure may include a rectangular second feedback cavity in microwave communication with each of the third main-line cavity and the fourth main-line cavity through the respective sidewall of the third main-line cavity and the fourth main-line cavity. In this case there would be a third-cavity feedback aperture between the second feedback cavity and the third main-line cavity, and a second-cavity feedback aperture between the second feedback cavity and the fourth main-line cavity. As with the embodiment having a single feedback cavity, it is preferred that each of the main-line cavities, the first feedback cavity, and the second feedback cavity share a base wall that lies in a common filter plane. The base wall is preferably the bottom of the single filter block of material. The second-feedback-cavity-sidewall length is selected in the same manner as described above. The two feedback cavities may be dimensioned similarly for redundant filtering, or differently for filtering different microwave modes.

A preferred method for fabricating a microwave waveguide filter comprises the steps of providing a single filter block of material, and fabricating the single filter block of material to have therein a main-line cavity structure comprising a group of at least two rectangular main-line cavities arrayed along a main propagation path and including a first main-line cavity and a second main-line cavity. Each main-line cavity includes a sidewall, and each pair of adjacent main-line cavities has a common transverse wall therebetween transverse to, and preferably perpendicular to, the main propagation path, and a main-line aperture in the common transverse wall. There is a rectangular first feedback cavity in microwave communication with each of the first main-line cavity and the second main-line cavity through the respective sidewall of the first main-line cavity and the second main-line cavity. A first-cavity feedback aperture opens between the first feedback cavity and the first main-line cavity, and a second-cavity feedback aperture opens between the first feedback cavity and the second main-line cavity. This main-line cavity structure is preferably machined, as by numerically controlled milling, into the single filter block of material. Consistent features discussed above may be used in conjunction with the method.

The present approach provides sign change coupling between adjacent cavities without any conductive probe extending between the adjacent cavities. In an alternative approach to a microwave waveguide filter that is not within the scope of the invention, a conductive probe extends between adjacent cavities (and without any aperture between the adjacent cavities). The conductive probe usually includes an electrically conductive rod or wire extending between the adjacent cavities, supported in an annular insulator that fills a hole in the wall between the cavities. This conductive probe achieves capacitive coupling between the adjacent cavities, but it requires two parts that must be produced and assembled for each such conductive probe. Additionally, the length of the conductive probe in each of the adjacent cavities must be fine tuned. In the present approach, on the other hand, there is no conductive probe extending between the cavities, and instead the microwave signal is communicated between adjacent cavities by an aperture that provides inductive coupling. Thus, the presently preferred approach vastly simplifies the fabrication time and cost of the microwave waveguide filter both by avoiding the use of conductive probes, and by the ability to fabricate the cavity structure, including both the walls and the apertures, in the single filter block of material. The filter block may be stacked with other filter blocks to form a stacked multichannel filter structure that is efficient from both a weight and a volumetric standpoint. Filter performance, such as for the $TE_{101}$ and $T_{102}$ modes discussed subsequently, is excellent.

The microwave performance of the array of rectangular cavities is readily modeled, so that its performance, and the precise configuration and dimensions required to produce a desired performance, may be predicted. The absolute dimensional lengths of the various walls are determined responsive to the microwave frequencies to be transmitted through the microwave waveguide filter. The present design approach then permits the microwave waveguide filter to be manufactured inexpensively and precisely to the required configurations, dimensions, and tolerances. The amount of fine tuning that is required to achieve the desired performance is therefore minimal, and may be accomplished, for example, by setting one or more tuning screws that extend through the cover of the main-line cavity structure.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
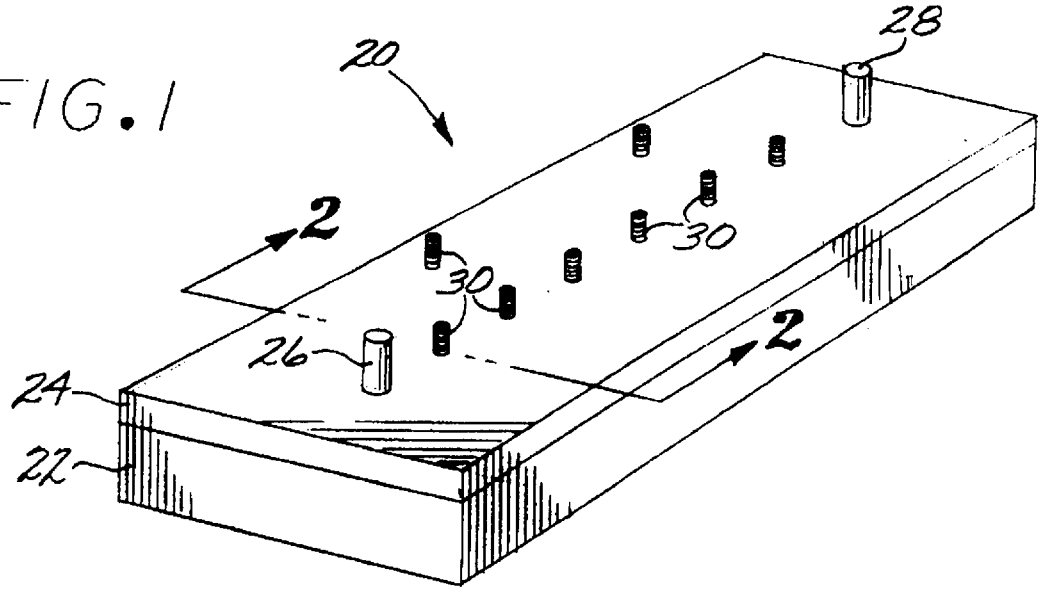
FIG. 1 is a perspective view of a first preferred embodiment of a microwave waveguide filter.
Figure 2:
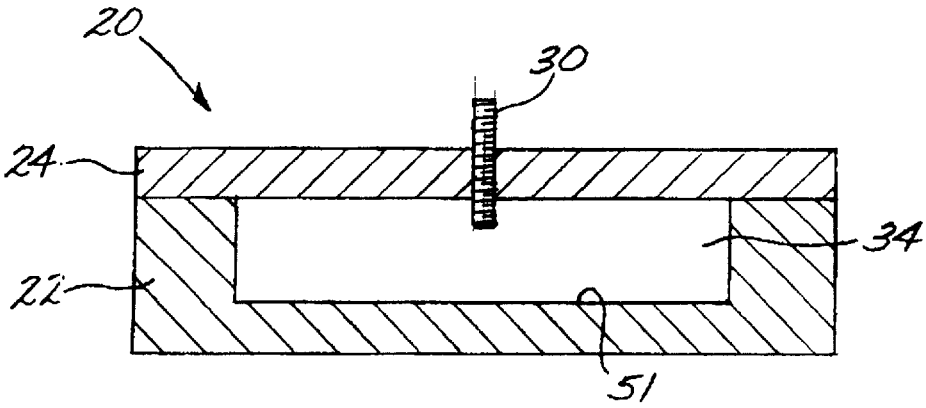
FIG. 2 is a schematic sectional view of the first preferred embodiment of FIG. 1, taken on line 2—2.

FIG. 1 depicts a microwave waveguide filter 26 formed in a single filter block of material 22 with a cover 24 affixed thereto. Extending through the cover 24 are an input structure 26 in the form of a microwave input probe and an output structure 28 in the form of a microwave output probe. A number of tuning screws 30 also extend through the cover 24, as may be seen in the sectional view of FIG. 2.

Figure 3:
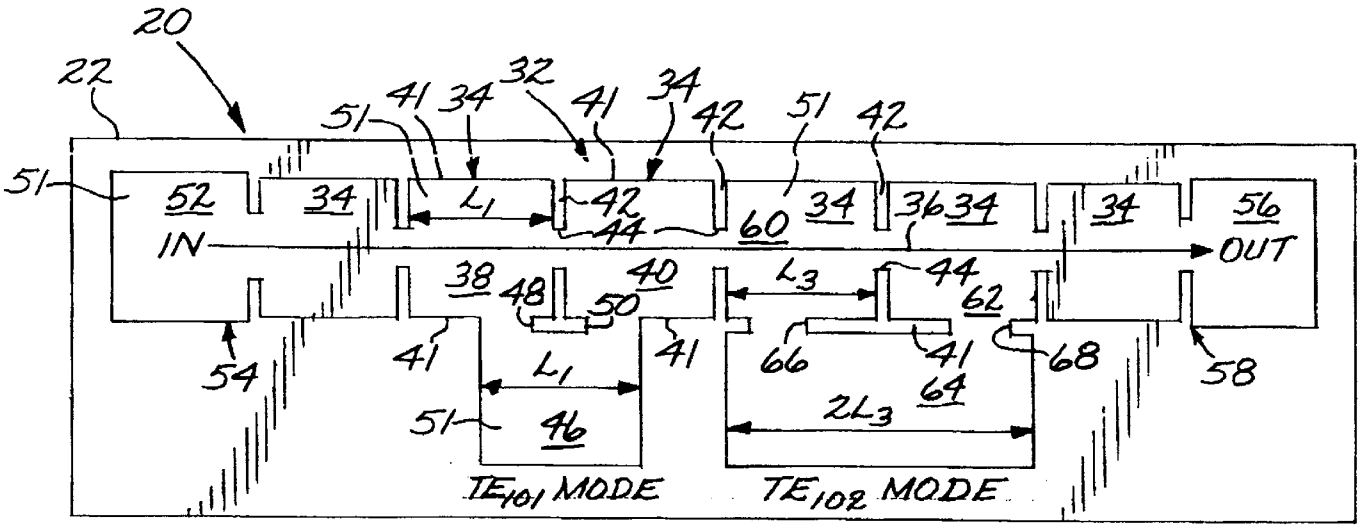
FIG. 3 is a plan view of a first version of the microwave waveguide filter of FIG. 1, with the cover removed.
Figure 4:
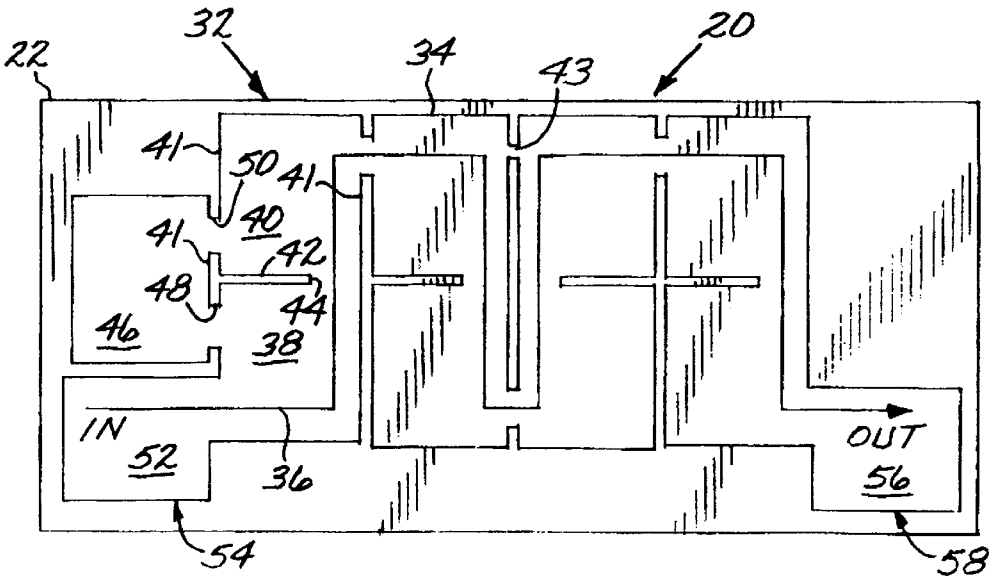
FIG. 4 is a plan view of a second version of the microwave waveguide filter of FIG. 1, with the cover removed.

When the cover 24 is removed, as in FIGS. 3–4, there is seen in plan view a main-line cavity structure 32 comprising a group of at least two rectangular main-line cavities 34 arrayed along a main propagation path 36. The main-line cavities 34 include a first main-line cavity 38 and a second main-line cavity 40. Each main-line cavity 38, 40 includes a sidewall 41. Each pair of adjacent main-line cavities, for example main-line cavities 38 and 40, has a common transverse wall 42 therebetween transverse to, and preferably perpendicular to, the main propagation path 36. There is a main-line aperture 44 in the common transverse wall 42 forming an opening between the two adjacent main-line cavities 38 and 40. (As used herein, an "aperture" is an unfilled opening.) There are additional main-line apertures between adjacent cavities, as for example the aperture 43 in FIG. 4. In FIGS. 3–4, there are additional cavities arranged along the main propagation path 36, with a common transverse wall and a main-line aperture between each pair of cavities.

The microwave waveguide filter 20 further includes a rectangular first feedback cavity 46 in microwave communication with each of the first main-line cavity 38 and the second main-line cavity 40 through the respective sidewall 41 of the first main-line cavity 38 and the second main-line cavity 40. Desirably, the walls of the main-line cavities 34 and the feedback cavities such as 46 are arranged rectilinearly, so that all of the walls are either parallel to or perpendicular to the other walls. There is a first-cavity feedback aperture 48 between the first feedback cavity 46 and the first main-line cavity 38, and a second-cavity feedback aperture 50 between the first feedback cavity 46 and the second main-line cavity 40. In all cases, it is preferred that each of the main-line cavities 34 and the first feedback cavity 46 have a base wall 51 (that is, the bottom or floor of the cavities in the plan view of FIGS. 3–4) that lies in a common filter plane.

In operation with a microwave signal introduced into the first main-line cavity 38, resonances are established in the first main-line cavity 38, the second main-line cavity 40, and the first feedback cavity 46, according to the absolute and relative dimensions of the cavities 38, 40, and 46. These resonances determine the nature of the microwave signal that leaves the second main-line cavity 40. Two embodiments will be discussed in more detail subsequently.

The microwave waveguide filter 20 further includes an input-end main-line cavity 52 at a first end 54 of the main-line cavity structure 32, and an output-end main-line cavity 56 at a second end 58 of the main-line cavity structure 32. The input structure 26 seen in FIG. 1 is in microwave communication with the input-end main-line cavity 52, and the output structure 28 seen in FIG. 1 is in microwave communication with the output-end main-line cavity 56. Any operable type of input structure 26 and output structure 28 may be used.

The main propagation path 36 extends through the main-line cavity structure 32 from the input-end main-line cavity 52 to the output-end main-line cavity 56. FIGS. 3 and 4 illustrate two alternative arrangements of the main-line cavities 34 along the main propagation path 36. In FIG. 3, the main-line cavity structure 32 is unfolded and linear, and the main propagation path 36 is substantially a straight line. In FIG. 4, the main-line cavity structure 32 is folded and nonlinear, and the main propagation path 36 is not substantially a straight line but instead is jogged. The folded form of the main propagation path is more compact in a lengthwise sense, but it does not allow as complete an access to the sidewalls of all of the main-line cavities 34 as in the unfolded form.

As illustrated in FIGS. 3–4, there may be multiple additional main-line cavities 34 between the input-end main-line cavity 52 and the output-end main-line cavity 56. In the embodiment of FIG. 3, the main-line cavity structure 32 includes a third main-line cavity 60 and a fourth main-line cavity 62. These main-line cavities 60 and 62 provide access for a rectangular second feedback cavity 64 in microwave communication with each of the third main-line cavity 60 and the fourth main-line cavity 62 through the respective sidewall 41 of the third main-line cavity 60 and the fourth main-line cavity 62. The access is provided through a third-cavity feedback aperture 66 between the second feedback cavity 64 and the third main-line cavity 60, and a fourth-cavity feedback aperture 68 between the second feedback cavity 64 and the fourth main-line cavity 62.

The main-line cavity structure 32 permits the use of either a single feedback cavity or more than one feedback cavity. When there is more than one feedback cavity, the feedback cavities may be made identical for redundancy in the filtering, or they may be made different to filter the microwave signal for different modes. FIG. 3 illustrates an embodiment where there are two feedback cavities of different dimensions for different filtering functionality. In this case, the first-cavity sidewall of the first main-line cavity 38 and the second-cavity sidewall of the second main-line cavity 40 are both of a first-sidewall length $L_1$. The first feedback cavity 46 has a first-feedback-cavity sidewall that is parallel to the first-cavity sidewall and to the second-cavity sidewall. The first feedback cavity 46 has a first-feedback cavity sidewall length of about the first-sidewall length $L_1$. The first main-line cavity 38, the second main-line cavity 40, and the first feedback cavity 46 are therefore configured to pass the $TE_{101}$ microwave mode. The third-cavity sidewall of the third main-line cavity 60 and a fourth cavity sidewall of the fourth main-line cavity 62 are both of a third-sidewall length $L_3$, which in a typical case is equal to $L_1$ but need not be equal to $L_1$. The second feedback cavity 64 has a second-feedback-cavity sidewall parallel to the third-cavity sidewall and the fourth-cavity sidewall. The second-feedback-cavity-sidewall length is about twice the third-sidewall length, or $2L_3$. The third main-line cavity 60, the fourth main-line cavity 62, and the second feedback cavity 64 are therefore configured to pass the $TE_{102}$ microwave mode.

This microwave filtering performance of this geometrically regular, readily fabricated array of rectangular main-line cavities and feedback cavities may be modeled and predicted for various sizes and geometries. The fabrication procedure is performed largely with a milling machine or similar device that machines the array of cavities to a good degree of precision. Nevertheless, some final fine tuning is often required, and the tuning screws 30 depicted in FIG. 1 are provided for some or all of the cavities to fine tune the resonances. The tuning screws 30 extend downwardly from the cover 24 and into one or more of the main-line cavities and/or the feedback cavities.

Figure 5:
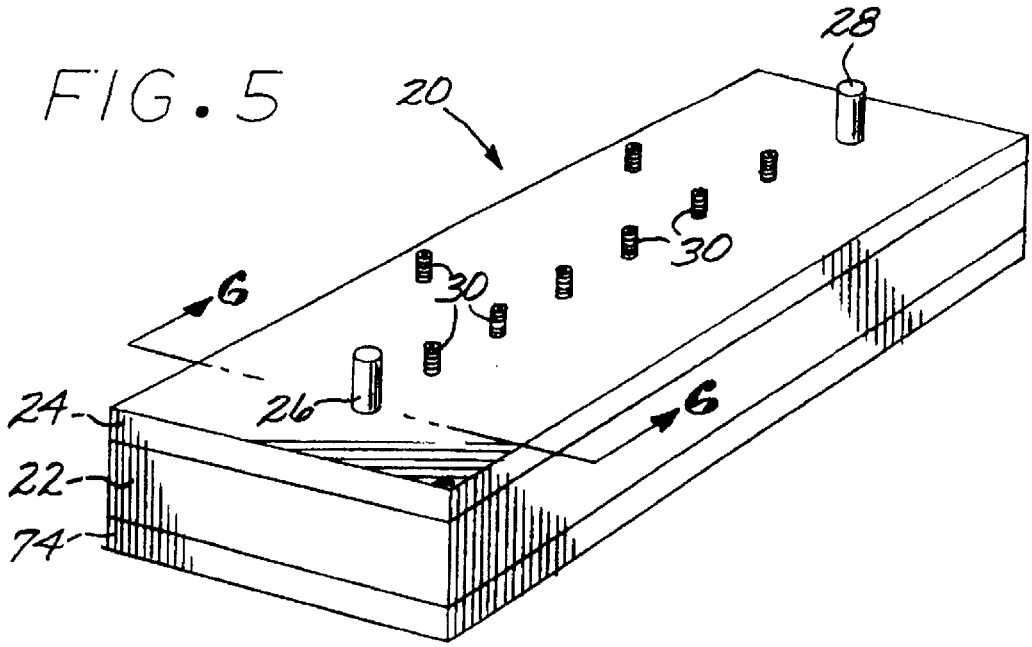
FIG. 5 is a perspective view, similar to FIG. 1, of a second preferred embodiment of the microwave waveguide filter.
Figure 6:
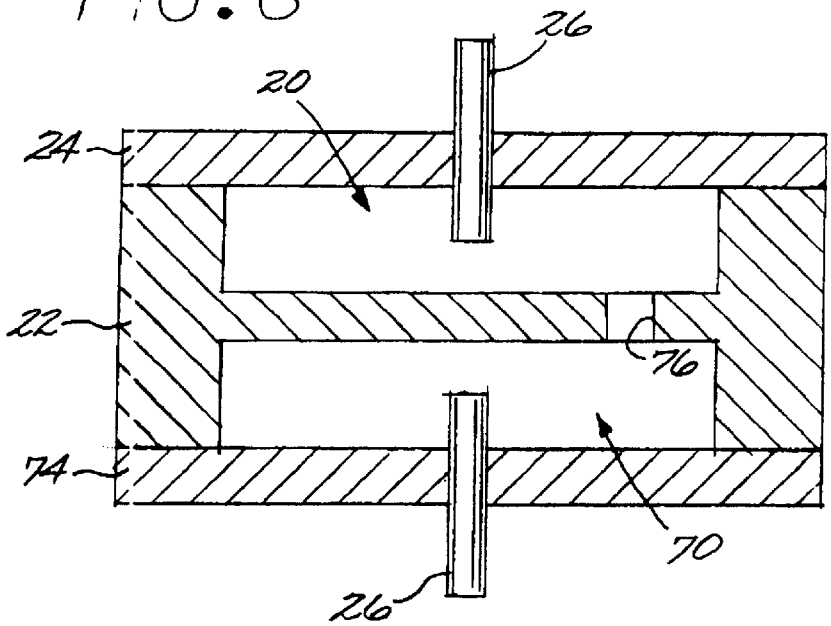
FIG. 6 is a schematic sectional view of the second preferred embodiment of FIG. 5, taken on line 6—6.

The basic single-filter block configuration of FIG. 1 may be used to fabricate a second microwave waveguide filter 70 in a back-to-back relation to the microwave waveguide filter 20, as shown in FIGS. 5–6. The second microwave waveguide filter 70 is formed with a second cavity structure 72 oppositely disposed from the microwave waveguide filter 20, and closed with a second cover 74. The second cavity structure 72 may be the same as that discussed above in relation to FIGS. 1–4, or it may be (and usually is) different. The second cavity structure 72 is provided with features like those discussed above, and the prior discussion is incorporated here as applied to the second cavity structure 72. The microwave waveguide filter 20 and the second microwave guide filter 70 may be microwave isolated from each other, or they may be interconnected with appropriate apertures 76.

Figure 7:
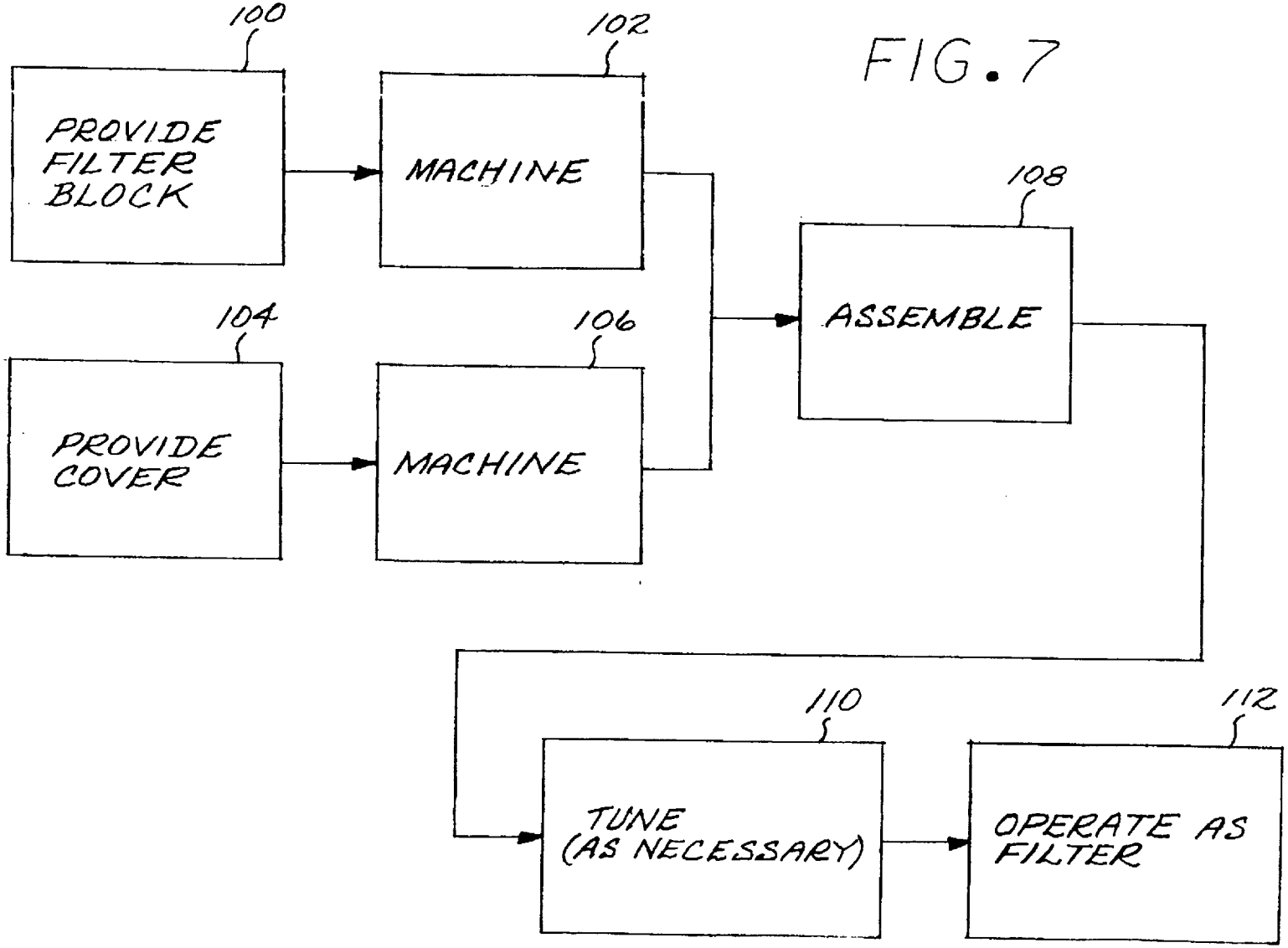
FIG. 7 is a block diagram of a preferred approach for fabricating and using the microwave filter waveguide.

A preferred fabrication method for the microwave waveguide filter 20 (and optionally the second microwave waveguide filter 70) is illustrated in FIG. 7. The single filter block is provided as a starting workpiece, step 100. The starting workpiece is machined with the desired pattern of the microwave waveguide filter or filters, step 102. The cover (or covers, for the embodiment of FIGS. 5–6) is provided as a starting workpiece, step 104, and machined, step 106. The cover 24 is assembled to the single filter block of metal 22, step 108, together with tuning screws 30 and the input/output structure 26, 28 as desired. The piece count for this final assembled structure is low, and the metal working is desirably accomplished by a standard technique such as milling. The manufacturing cost is therefore low. The assembly is tuned as necessary, step 110, and operated as a filter, step 112. Experience has shown that the tuning is much faster and less time consuming than in conventional tuning, leading to reduced cost. No conductive probes extend between adjacent cavities in the preferred structure.

Figure 8:
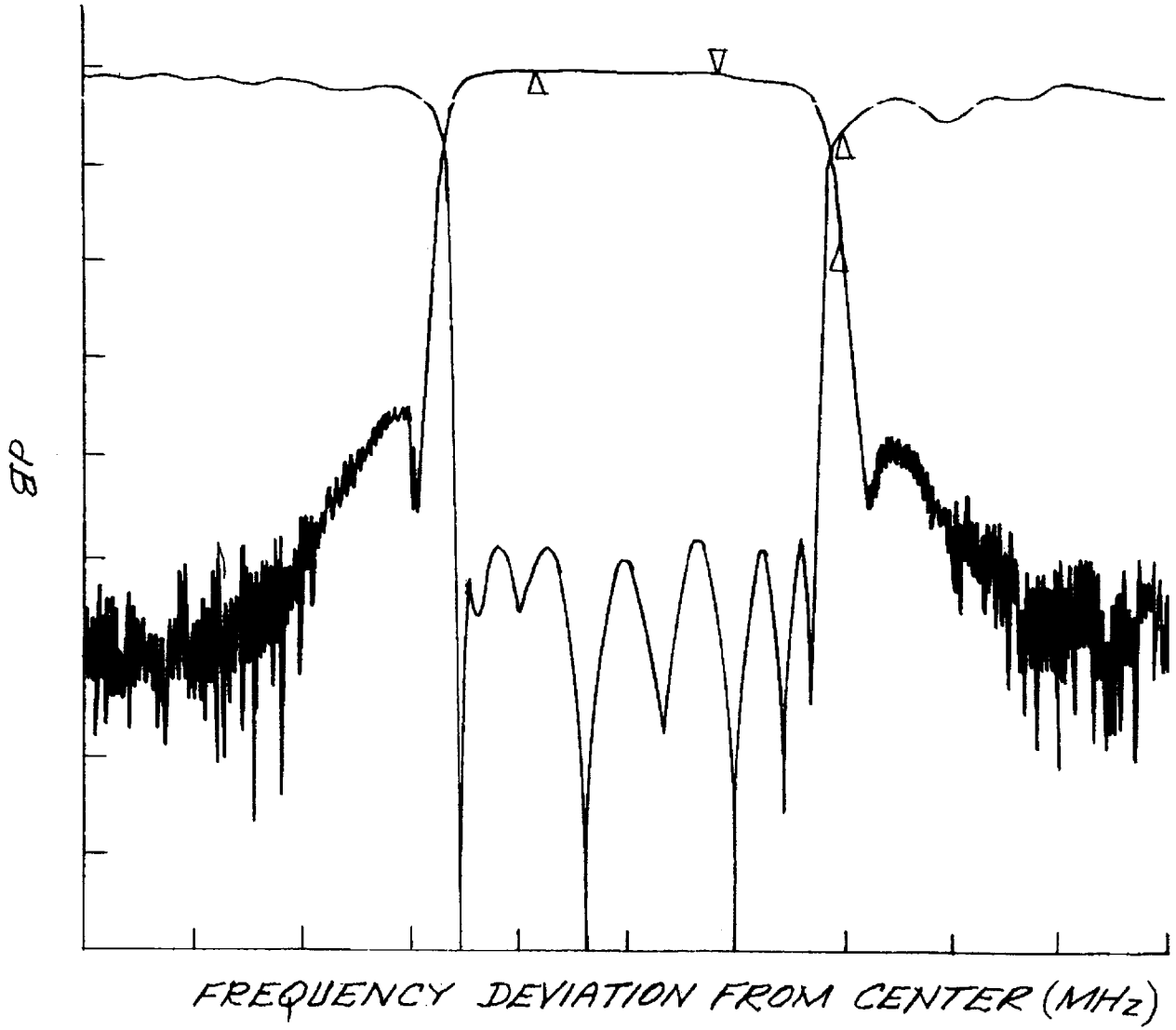
FIG. 8 is a graph of filter response for the microwave waveguide filter of FIG. 3.
Figure 9:
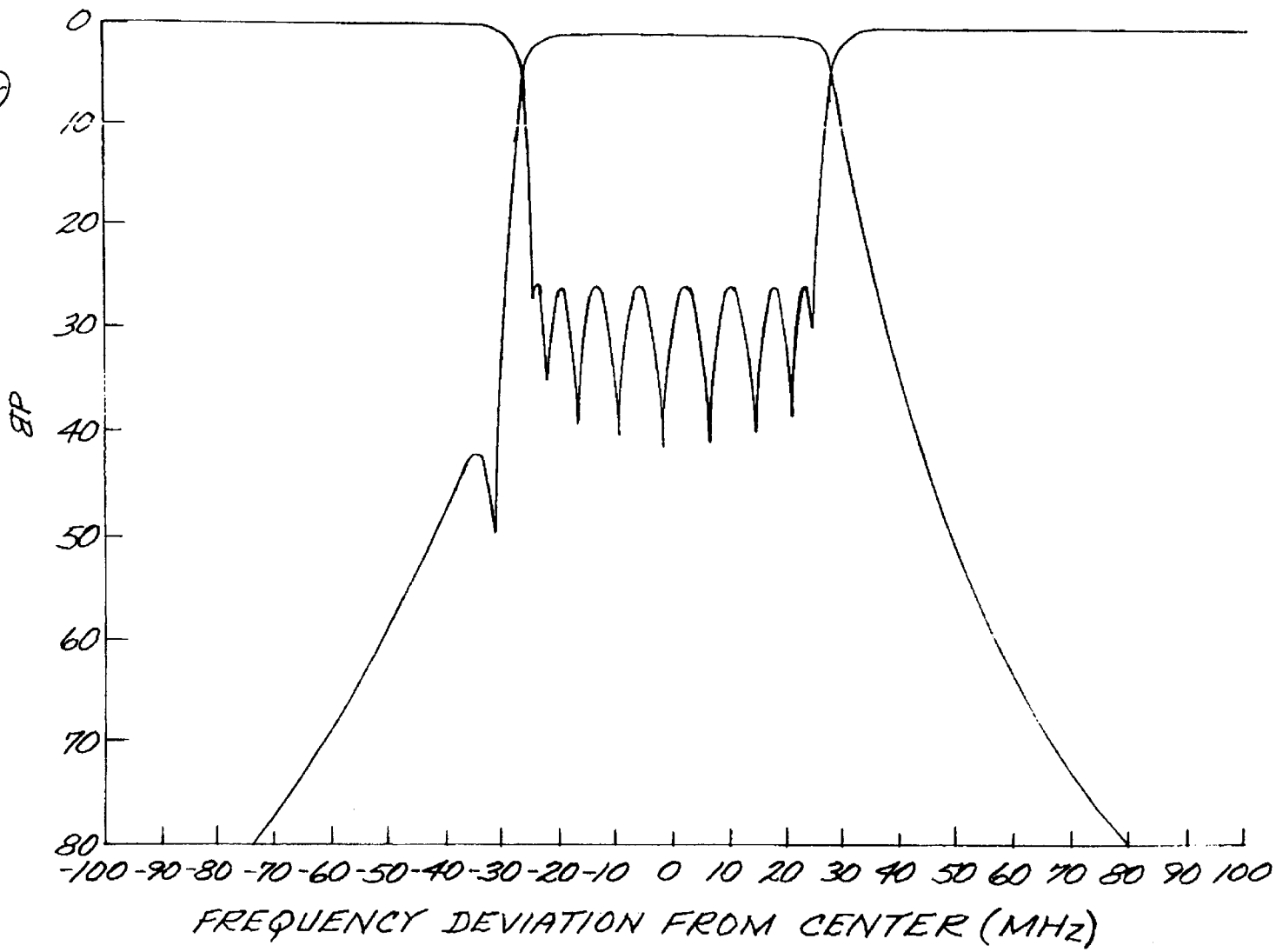
FIG. 9 is a graph of filter response for the microwave waveguide filter of FIG. 4.

The present invention has been reduced to practice for a design like that of FIG. 3. FIGS. 8–9 illustrate the microwave performance.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A microwave waveguide filter comprising a main-line cavity structure comprising a group of at least two rectangular main-line cavities arrayed along a main propagation path and including a first main-line cavity and a second main-line cavity, wherein each main-line cavity includes a sidewall, and wherein each pair of adjacent main-line cavities has a common transverse wall therebetween transverse to the main propagation path, and a main-line aperture in the common transverse wall; and a rectangular first feedback cavity in microwave communication with each of the first main-line cavity and the second main-line cavity through the respective sidewall of the first main-line cavity and the second main-line cavity, there being a first-cavity feedback aperture between the first feedback cavity and the first main-line cavity, and a second-cavity feedback aperture between the first feedback cavity and the second main-line cavity.

2. The microwave waveguide filter of claim 1, wherein the main-line cavity structure includes an input-end main-line cavity at a first end of the main-line cavity structure, and an output-end main-line cavity at a second end of the main-line cavity structure, and wherein the main-line cavity structure further includes an input structure in microwave communication with the input-end main-line cavity, and an output structure in microwave communication with the output-end main-line cavity.

3. The microwave waveguide filter of claim 1, wherein the main-line cavity structure is unfolded and the main propagation path is substantially a straight line.

4. The microwave waveguide filter of claim 1, wherein the main-line cavity structure is folded and the main propagation path is not substantially a straight line.

5. The microwave waveguide filter of claim 1, wherein each of the main-line cavities and the first feedback cavity have a base wall that lies in a common filter plane.

6. The microwave waveguide filter of claim 1, wherein a first-cavity sidewall of the first main-line cavity and a second-cavity sidewall of the second main-line cavity are both of a first-sidewall length, and the first feedback cavity has a first-feedback cavity sidewall length of about the first-sidewall length.

7. The microwave waveguide filter of claim 1, wherein a first-cavity sidewall of the first main-line cavity and a second-cavity sidewall of the second main-line cavity are both of a first-sidewall length, and the first feedback cavity has a first-feedback cavity sidewall length of about two times the first-sidewall length.

8. The microwave waveguide filter of claim 1, wherein the main-line cavity structure and the first feedback cavity are formed in a single filter block of material.

9. The microwave waveguide filter of claim 8, further including a second microwave waveguide filter in a back-to-back relation to the microwave waveguide filter.

10. The microwave waveguide filter of claim 8, further including a single cover overlying and affixed to the single filter block of material.

11. The microwave waveguide filter of claim 1, wherein the main-line cavity structure includes a third main-line cavity and a fourth main-line cavity.

12. The microwave waveguide filter of claim 11, further including a rectangular second feedback cavity in microwave communication with each of the third main-line cavity and the fourth main-line cavity through the respective sidewall of the third main-line cavity and the fourth main-line cavity, there being a third-cavity feedback aperture between the second feedback cavity and the third main-line cavity, and a fourth-cavity feedback aperture between the second feedback cavity and the fourth main-line cavity.

13. The microwave waveguide filter of claim 12, wherein each of the main-line cavities, the first feedback cavity, and the second feedback cavity have a base wall that lies in a common filter plane.

14. The microwave waveguide filter of claim 12, wherein a third-cavity sidewall of the third main-line cavity and a fourth cavity sidewall of the fourth main-line cavity are both of a third-sidewall length, the first feedback cavity has a first-feedback-cavity-sidewall length of about the first-sidewall length, and the second feedback cavity has a second-feedback-cavity-sidewall length of about the third-sidewall length.

15. The microwave waveguide filter of claim 12, wherein the main-line cavity structure, the first feedback cavity, and the second feedback cavity are formed in a single filter block of material.

16. A microwave waveguide filter comprising a main-line cavity structure comprising a group of at least two rectangular main-line cavities arrayed along a main propagation path and including a first main-line cavity and a second main-line cavity, wherein each main-line cavity includes a sidewall, and wherein each pair of adjacent main-line cavities has a common transverse wall therebetween perpendicular to the main propagation path and a main-line aperture in the common transverse wall; and a rectangular first feedback cavity in microwave communication with each of the first main-line cavity and the second main-line cavity through the respective sidewall of the first main-line cavity and the second main-line cavity, there being a first-cavity feedback aperture between the first feedback cavity and the first main-line cavity, and a second-cavity feedback aperture between the first feedback cavity and the second main-line cavity, wherein each of the main-line cavities and the first feedback cavity have a base wall that lies in a common filter plane, and wherein a first-cavity sidewall of the first main-line cavity and a second-cavity sidewall of the second main-line cavity are parallel and both of a first-sidewall length, and the first feedback cavity has a length measured parallel to the first-cavity sidewall selected from the group consisting of about the first-sidewall length and about twice the first-sidewall length.

17. A method for fabricating a microwave waveguide filter, comprising the steps of providing a single filter block of material; and fabricating the single filter block of material to have therein a main-line cavity structure comprising a group of at least two rectangular main-line cavities arrayed along a main propagation path and including a first main-line cavity and a second main-line cavity, wherein each main-line cavity includes a sidewall, and wherein each pair of adjacent main-line cavities has a common transverse wall therebetween transverse to the main propagation path and a main-line aperture in the common transverse wall, and a rectangular first feedback cavity in microwave communication with each of the first main-line cavity and the second main-line cavity through the respective sidewall of the first main-line cavity and the second main-line cavity, there being a first-cavity feedback aperture between the first feedback cavity and the first main-line cavity, and a second-cavity feedback aperture between the first feedback cavity and the second main-line cavity.

18. The method of claim 17, wherein the step of fabricating includes the step of machining the main-line cavity structure and the first feedback cavity into the single filter block of material.

* * * * *